United States Patent [19]

Yanagida

[11] 4,307,642

[45] Dec. 29, 1981

[54] MEAT SLICER

[75] Inventor: Shinji Yanagida, Yao, Japan

[73] Assignee: Nantsune Tekko Kabushiki Kaisha, Fujiidera, Japan

[21] Appl. No.: 137,264

[22] Filed: Apr. 4, 1980

[30] Foreign Application Priority Data

Apr. 7, 1979 [JP] Japan ..... 54-46669[U]

[51] Int. Cl.³ ..... B26D 7/06

[52] U.S. Cl. ..... 83/718; 83/731

[58] Field of Search ..... 83/713–718, 83/730, 731

[56] References Cited

U.S. PATENT DOCUMENTS 1,323,054 11/1919 Herod ..... 83/718

1,982,175 11/1934 Peters ..... 83/718

*Primary Examiner*—J. M. Meister

*Attorney, Agent, or Firm*—Holman & Stern

[57] ABSTRACT

The present invention provides, in a meat slicer comprising a circular blade rotatable vertically on one side of the machine frame, a meat case whch travels forward and backward horizontally on the machine frame along the plane of rotation of said circular blade and lower and upper conveyor apparatus provided on the top and bottom parts of said meat case so as to hold therebetween a block of soft and shapeless meat and force it toward said circular blade to be sliced in desired uniform thickness ranging from several millimeters to 30 millimeters continuously, a structure for the meat case and a mounting device for a driving mechanism to facilitate cleaning of the machine before and after operation and insure effective sanitary control.

6 Claims, 9 Drawing Figures

23
52
31
33
28
51
16
6
7e
B
21
26
f'36
57
P1
17
15
13
14
20
f
E
9
7
39a
12
11
8
3b
3
3a
56
38
65'
67b
41b
65
67c
Cb
40b
27
29
37
a
Ca
b
34
14
17
5
4
18
7a
2
10
53
Y
21'
40a
35
Y'
67a
41a

MEAT SLICER

BACKGROUND OF THE INVENTION

The present invention relates to a meat slicer and, more particularly, to a meat slicer of novel type provided with a circular blade adapted to rotate perpendicularly on one side of the upper part of a box-type machine frame, a meat case adapted to reciprocate horizontally on the plane of rotation of said circular blade, and a set of upper and lower conveyors provided on the upper and lower parts of the meat case and adapted to move intermittently in conjunction with the return motion of the meat case while holding a block or lump of raw meat therebetween, so that the meat block is pushed forward intermittently to the front end of the meat case with the result that said block of soft and shapeless raw meat can be sliced to a thickness of several millimeters automatically and continuously.

Hitherto in the United States there have been introduced many types of slicers designed to slice processed, solid meat materials like ham, sausage and bacon, but there has been little use of slicers adapted to slice soft, shapeless and unprocessed meat to be used, for example, for Sukiyaki cooking, due to different dietary customs.

However, occasioned by a notable trend toward diversification and internationalization of cooking in the United States in recent years, there has been an increased demand for sliced raw meat and consequently for a slicer for this purpose.

Since meat slicer of this kind is to work on raw meat which has not undergone any heat treatment, it needs to be specially contrived so as to minimize its contact with the meat to be worked on or to make the machine parts contacting the meat easily detachable for washing in water, or to expose the machine surface to easy access for washing by simply applying highly pressurized water, or to devise a structure so as to prevent the passage of the washing water into the driving mechanism of the machine.

The slicer of the present invention has been devised to satisfy all such requirements.

SUMMARY OF THE INVENTION

An object of the present invention is therefore to provide a meat slicer which will prevent small pieces of meat or fat waste generated during the operation of the machine from sticking to the component elements of the driving mechanism and further permit easy washing in water, by forming a hollow crank chamber by and between the upper bed plate and the lower bed plate of the machine to enclose therein a driving mechanism for actuating the reciprocating movement of the meat case.

Another object of the invention is to provide a meat slicer which permits easy cleaning of its machine parts directly contacting the meat, by making a lower conveyor means on the bottom part of the meat case easily detachable from the meat case.

A further object of the present invention is to provide a meat slicer which permits easy cleaning of its machine parts held in direct contact with the meat for most of the time, by making an upper conveyor means on the upper part of the meat case easily detachable from its supporting member which also constitutes a driving means for it.

These and other objects of the present invention will become apparent from the following description made in reference to the appended drawings of preferred embodiments of the present invention.

DESCRIPTION OF THE PREFERRED EMBODIMENT

Figure 1:
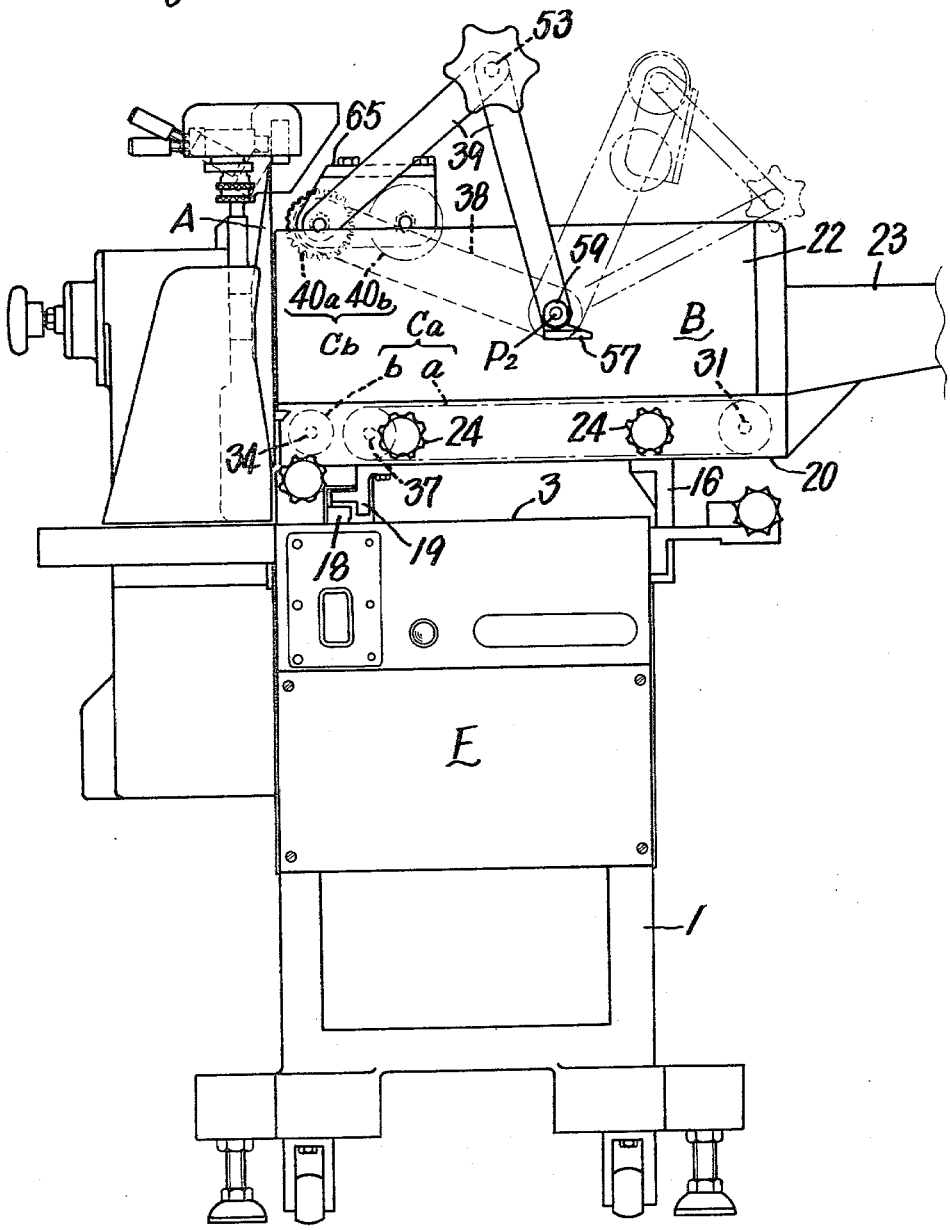
FIG. 1 is a front elevation of a meat slicer according to the present invention.
Figure 2:
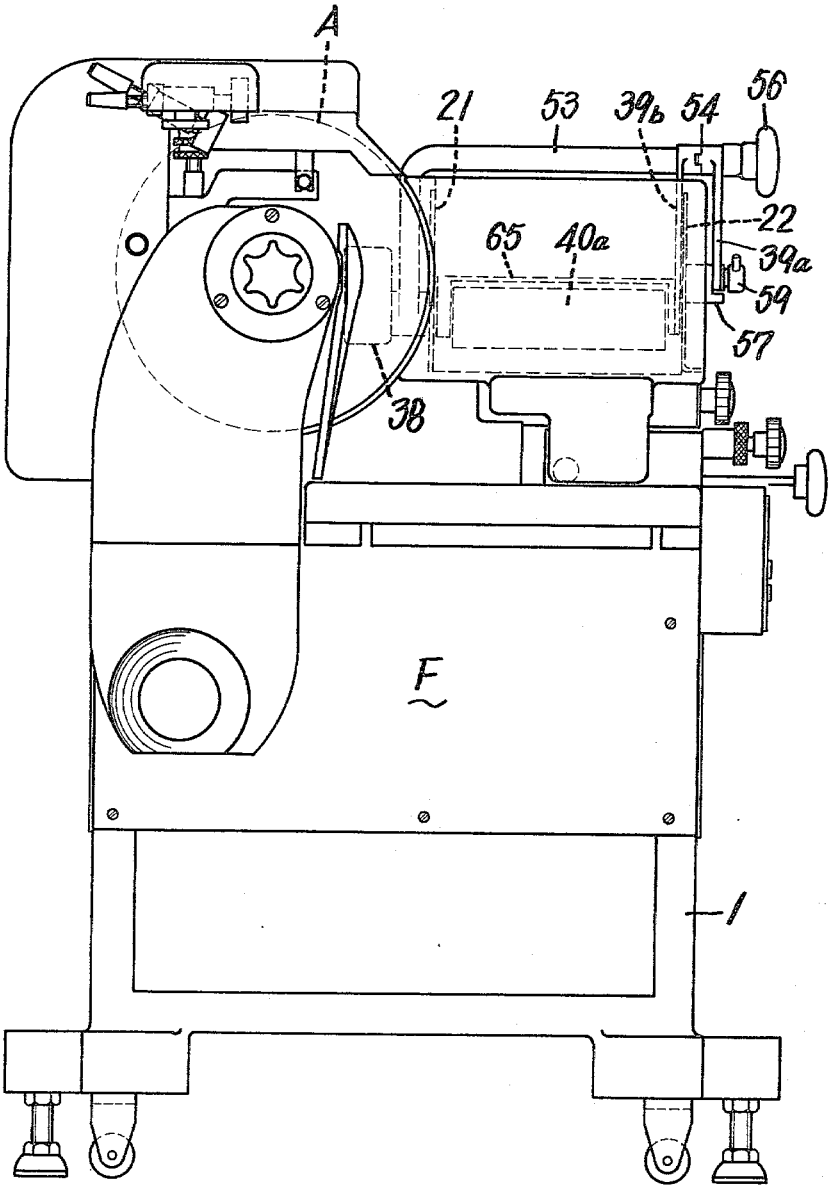
FIG. 2 is a side elevation of FIG. 1 as viewed from the left side of the machine of FIG. 1.

In FIG. 1 and FIG. 2, the symbol F denotes a housing or frame of the slicer according to the present invention, (a) showing a circular blade, (b) a meat case, Ca lower conveyor member and Cb an upper conveyor.

A block or lump of meat to be sliced is placed on the lower conveyor Ca provided on the bottom surface of the meat case B, while the upper conveyor Cb supported on the tip of an arm member which is pivotally mounted at one side of the meat case B is laid over the meat block from above, thereby clamping the meat between the conveyors Ca and Cb. The meat block in that position is pushed forward intermittently toward the front end of the meat case B.

Figure 8:
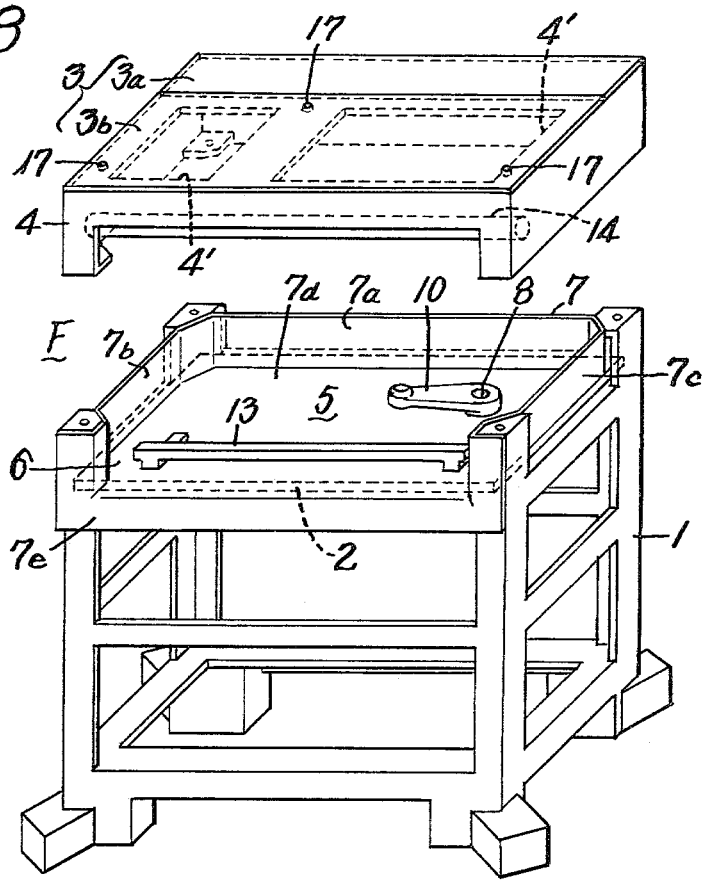
FIG. 8 is a perspective view, partly in exploded state, of part of the machine frame, and, FIG. 9 is a plan view, partly in section, of the mounting of an auxiliary arm.
Figure 9:
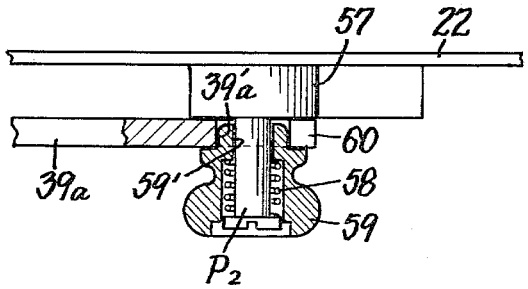

As shown in FIG. 8, a lower frame member 1 is formed by crosslinking vertical angles at four corners with lateral angles at suitable space interval, and the member 2 is a lower bed. The member 3 is an upper bed plate constituting the upper surface of the machine frame F, and the member 4 is an upper bed provided on its upper portion with the upper bed plate 3 and rigidly secured onto the upper surface of the lower frame member 1. Element 5 is a hollow crank chamber formed on the upper part of said lower frame 1 by and between the lower bed 2 and said upper bed 4, and 6 is an elongated opening provided on one side of the crank chamber 5 longitudinally in the moving direction of the meat case B. The numeral 7 is a stainless steel receiving tray engaging in the upper bed 4 and constituting the interior surface of the crank chamber 5, composed integrally of a side surface *7a* provided opposite to the opening 6, front and rear side surfaces *7b* and *7c* provided at right angles on the right and left thereof, a bottom surface *7d* laid over the lower bed 2 and a peripheral surface *7e* forming the peripheral edge of said opening 6.

The member 8 is a crank shaft so provided as to protrude perpendicularly into the crank chamber 5 from a gear box 9 provided on the under surface of the lower bed 2 through an axle hole communicating the bottom surface *7d* of the receiving tray 7 and the lower bed 2. The member 10 is a crank secured to the upper end of the crank shaft 8 and disposed to rotate horizontally, and the member 11 is a sealing member fitted into the base end of the crank 10. Element 12 is a connecting rod having having its one end connected to the crank 10, 13 being a lower rail member of square-bar shape fixed to the bottom surface *7d* of the receiving tray longitudinally of the opening 6 of the crank chamber 5. Element 14 is an upper rail member having round-bar shape laid transversely on the inner side surfaces of the upper frame or bed in parallel with the lower rail, and 15 a slide metal disposed to reciprocate in the crank chamber 5 with the rotation of the crank 10 by engaging in the upper and lower rails 13 and 14 and connecting to the other end of the connecting rod 12.

The member 16 is a slide bracket having its lower and fixed to the slide metal 15 for engagement in the opening 6 of the crank chamber 5 and its upper end fixed to the rear under-side of the meat case B, so that said slide bracket may reciprocate integrally with the slide metal 15 along the opening 6 upon rotation of the crank 10, thereby causing the meat case B to move forward and backward in relation to the circular blade A. Said crank 10 is driven by the motor (not illustrated) provided inside the lower frame member 1 on the under-side of the lower bed 2 through a worn transmission means disposed inside the gear box 9.

The slicer constructed as above, carrying at the upper part of its frame F the hollow crank chamber 5 formed by the upper bed plate 3 as its upper surface and the receiving tray 7 as its lower surface, prevents small pieces of meat or fat generated in the meat case B during the machine operation from falling down into the driving mechanism contained in the meat case B and sticking to the crank 10, the connecting rod 12 and other components of the driving mechanism since the upper surface of the machine frame F on which the meat case B travels is covered by the upper bed plate 3. This covering also permits easy removal of soil and waste elements deposited on said bed plate 3 and also insures the safe use of the machine by preventing the driving mechanism from being exposed open on the surface of the machine frame and thereby eliminating hazard or danger during the operation.

Figure 4:
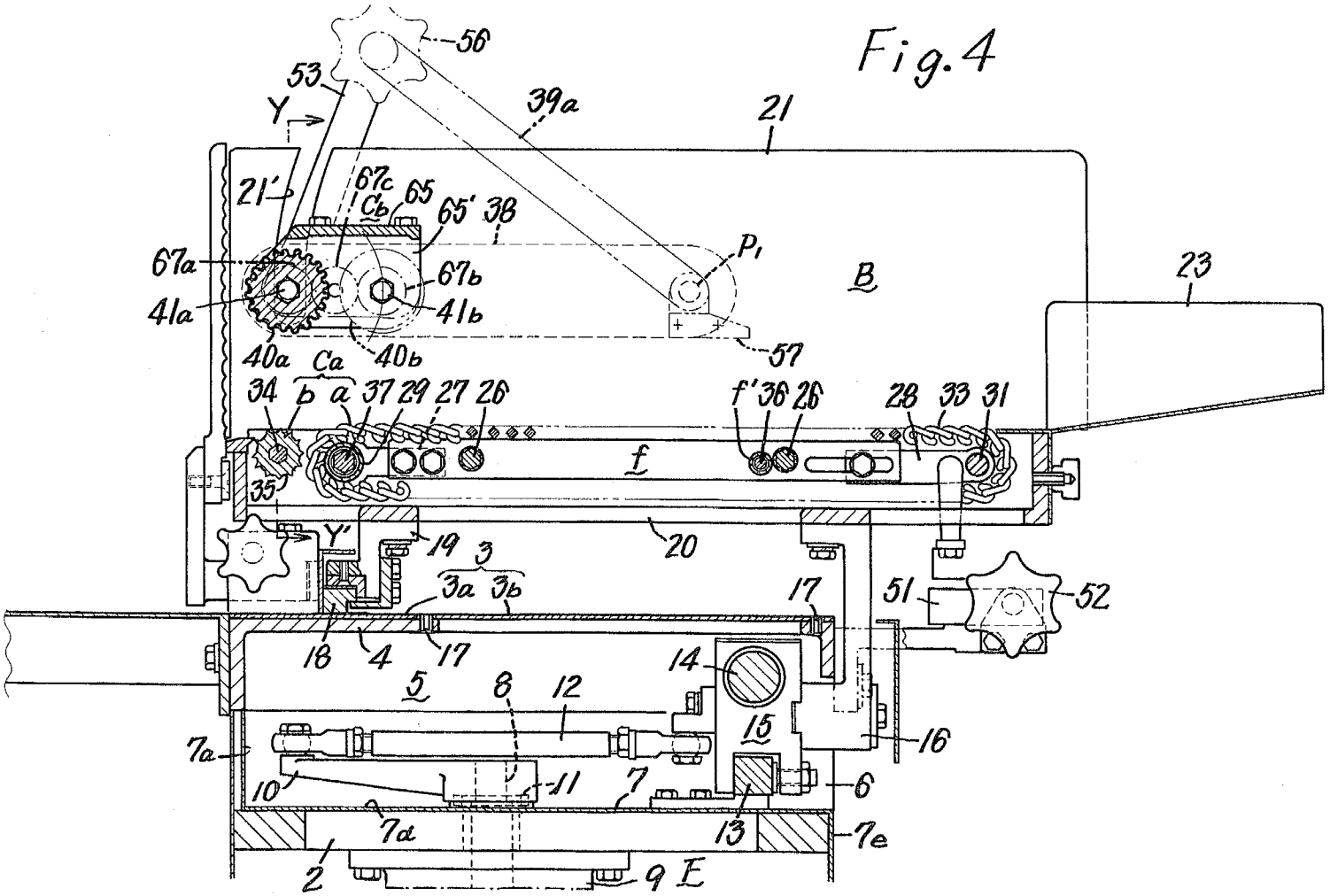
FIG. 4 is a cross-sectional view taken along X—X′ line of FIG. 3.

The upper bed plate 3 comprises, as shown in FIG. 4 and FIG. 8, a plate member *3a* fixed rigidly to the upper bed 4 and a cover plate *3b* removably secured onto said bed 4 by means of its engagement in a plurality of knock pins 17 provided on the upper bed 4. Said fixed plate *3a* is provided on its upper surface with a front rail 18 fixed thereto and engaged by a front slide bracket 19 extending from the front under-surface of the meat case B.

The cover plate *3b* can be easily removed from the knock pins to permit easy cleaning of the slicer. When the cover plate *3b* is removed, the window hole 4' provided on the upper bed 4 becomes exposed to let the upper part of the crank chamber 5 open so that the interior of the crank chamber 5 can be easily washed clean with pressurized water applied or poured in from the upper part of the machine frame F. The poured-in water is prevented by the receiving tray 7 forming the interior surface of the crank chamber 5 from getting into the under-side of the lower bed 2 where the gear box 9 and the motor are mounted and is discharged outside the frame F through the periphery *7d* formed on the peripheral edge of the opening 6 provided at one side of the receiving tray 7.

The meat case B which travels forward and backward on the upper surface of the machine frame F is composed integrally of, as shown in FIG. 1, FIG. 2, FIG. 6 and FIG. 7, a rectangular lower frame 20 on its lower part, a conduit-type material accepting board 23 provided at the rear end of said lower frame 20, a fixed side wall 21 provided upright on its one side and another upright side wall provided removably on its other side by means of a pair of front and rear screws 24 and 24, thereby forming a case configuration with its top surface and front and rear sides left open.

The lower conveyor Ca provided on the bottom of the meat case B has a horizontal conveying surface consisting of a front-end delivery part (b) and a conveying part (a) which follows the part (b). The conveying part (a) constitutes an inner frame (f) comprising a pair of side frames 25 and 25 provided longitudinally of the lower frame member 20, a pair of front and rear stay bars 26 and 26, a pair of fixed bearing members 27 and 27 extending from the front end of said frame 20, a pair of movable bearing members 28 and 28 extending from the rear end of said frame with an adjustable length.

Figure 3:
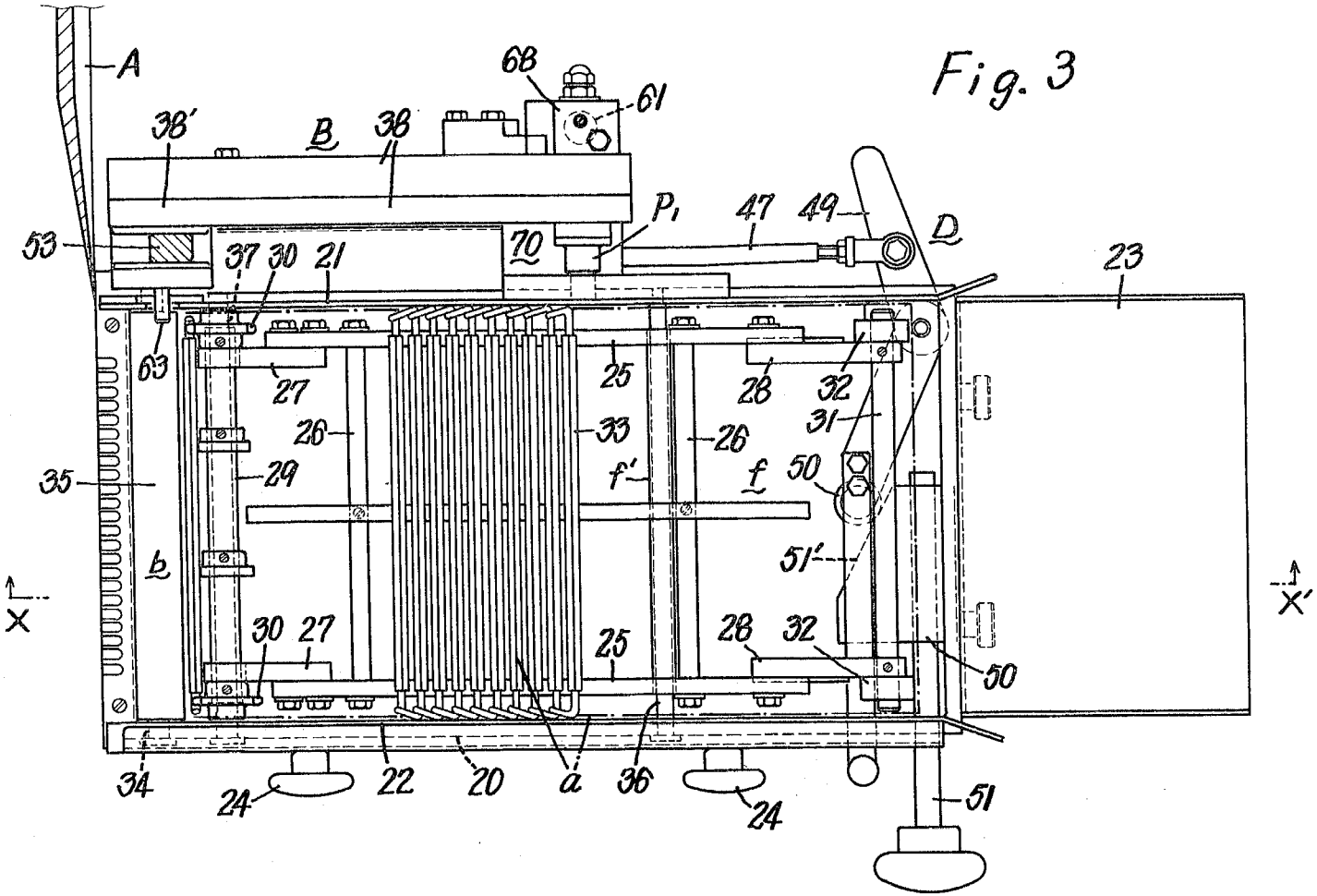
FIG. 3 is a plan view, showing principally a meat case of the slicer.

A front pipe shaft 29 having its both ends movably mounted on the fixed bearing members 27 and 27 of the inner frame (f) is horizontally laid across said frame (f), and said shaft 29 carries a pair of chain wheels 30 and 30 fixed at its both ends. The member 31 is a tension shaft laid horizontally across the movable bearing member 28 and 28 and carrying on its both ends a pair of rotatable tension pulleys 32 and 32. Between and across said chain wheel 30 and the pulley 32 as shown in FIG. 3 is provided a bar conveyor belt 33 made up of a number of parallel-laid metal square bars (with each bar having its both ends of suitable length formed into round shape), said round-shaped end portions being bent and coiled around the next succeeding square bar and further having each of its both ends connected to an endless chain link.

The front-end delivery portion (b) is formed by first having a driving shaft 34 of hexagonal cross section thrusted through the center of a plastic spike roller 35, with journal parts 34' and 34' provided on both ends of said driving shaft 34 being journaled in an axle hole 20' and 20' provided on the lower frame 20 of the meat case B.

The conveying part (a) has, apart from the stay bars 26 and 26, a guide pipe 35 secured to the side frames 25 and 25 at the middle to the rear part of the inner frame (f). A removable stay shaft 36 is inserted into the guide pipe 35 from the outside (viewing FIG. 4 from the front) of the lower frame 20 provided with the removable side wall 22 of the meat case B toward the other side.

Figure 6:
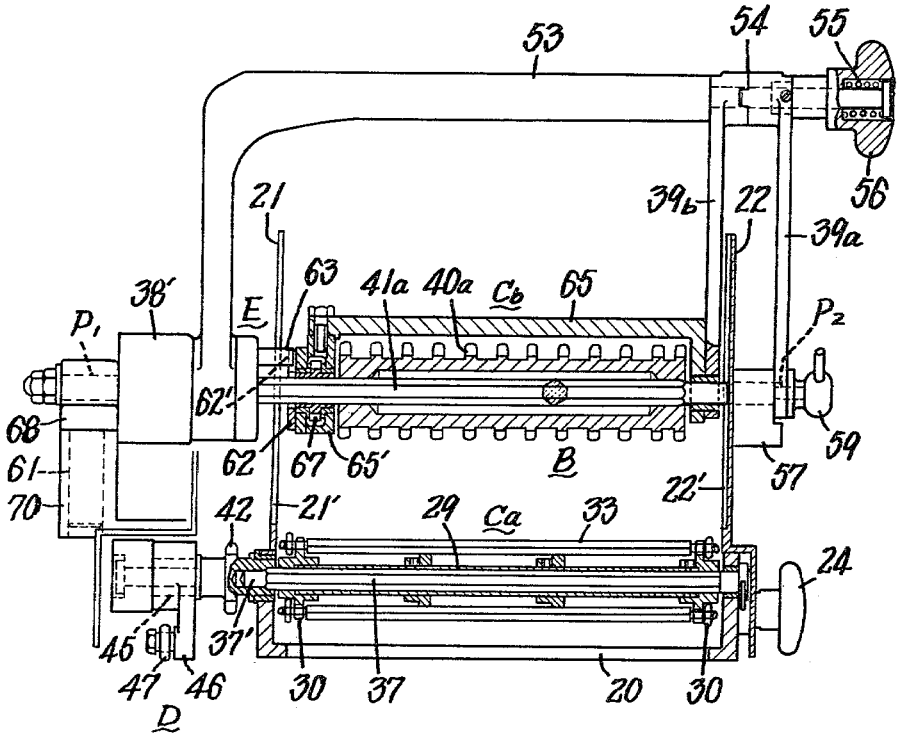
FIG. 6 is a cross-sectional view taken along Y—Y′ line of FIG. 4.

Also, as shown in FIG. 6, a driving shaft 37 of hexagonal cross section carrying journals 37' and 37' at both ends is inserted through the front pipe shaft 29 in a similar manner so that the conveying section (a) is removably supported in the lower frame 20 by means of said two shafts 36 and 37.

The tip ends of said drive shaft 37 and the drive shaft 34 are, as shown in FIG. 6, respectively fitted in the inner ends of front and rear chain wheels 42 and 43 rotatably mounted in one of the side walls of the lower frame 20 from outside, whereby, when one of the chain wheels 42 is driven, the other wheel 43 is also rotated anti-clockwise as illustrated in FIG. 4, by means of a chain 44 so as to drive the lower conveyor Ca.

The conveying section (a) of the lower conveyor Ca so constructed can be easily removed from the lower frame 20 by first removing one of the side walls 22 of the meat case B by loosening the screws 24 and 24 and then taking out the two shafts 36 and 37 supporting the inner frame (f) to the right as seen in FIG. 6. Likewise, the delivery part (b) can be removed easily by first taking out the drive shaft 34 in the same direction so as to disassemble the spike roller 35 inside the lower frame 20.

When the lower conveyor Ca is removed from the meat case B in the manner described above, the interior of the meat case B which is deposited with tiny pieces of meat and fat can be easily washed off with water. Further, the conveyor Ca so removed can be thoroughly cleaned with water. The bar conveyor belt 33 made up of a member of square bars have in itself little area to be soiled, and moreover, it can be washed clean and neat after removed by loosening the movable bearing members 28 and 28. The interior of the meat case B can be cleaned very easily by taking off the removable side wall 22 of the case B.

With the construction and functions of the lower conveyor Ca as explained above, an explanation will be made of the upper conveyor Cb co-acting with the lower conveyor Ca to advance the work material, as follows:

The upper conveyor Cb is mounted on the tip ends of a pair of right and left arms composed of an arm 38 which has a pivotal axis $P_1$ on the outer side of the fixed side wall 21 of the inner case B and is freely swingable in parallel with said wall 21 and an auxiliary arm 39 which has a pivotal axis $P_2$ on the outer side of the other side wall 22 and is freely swingable in parallel with said arm 38. Said arms 38 and 39, when leaning forward over the meat case B, are so disposed as to engage with the meat case B to make pressure contact by its own weight with the upper front part of the work material.

The upper conveyor Cb comprises a pair of paralleled front and rear spike rollers 40 and 40, a pair of rotary shafts of hexagonal cross-section 41*a* and 41*b* which thrust through the centers of the spike rollers 40 and 40, a frame 65 which rotatably supports the shafts 41*a* and 41*b* at their respective ends, a gear assembly 67 made up of three gears composed of a pair of gears 67*a* and 67*b* mounted in one of side walls 65' of the frame 65 and disposed to engage with the rotatory shafts 41*a* and 41*b* and a pinion gear 67*c* provided intermediate between said two gears.

With the rotation of the front-end rotatory shaft 41*a*, said pair of the upper and lower spike rollers 40 and 40 are caused to rotate as shown in FIG. 4. Said front-end rotatory shaft 41*a* thrusts through an arcuate slot 21' formed on the fixed side wall 21 of the inner frame B and is received rotatably on the tip end of the externally disposed arm 38 in a one-sided supporting condition.

Figure 5:
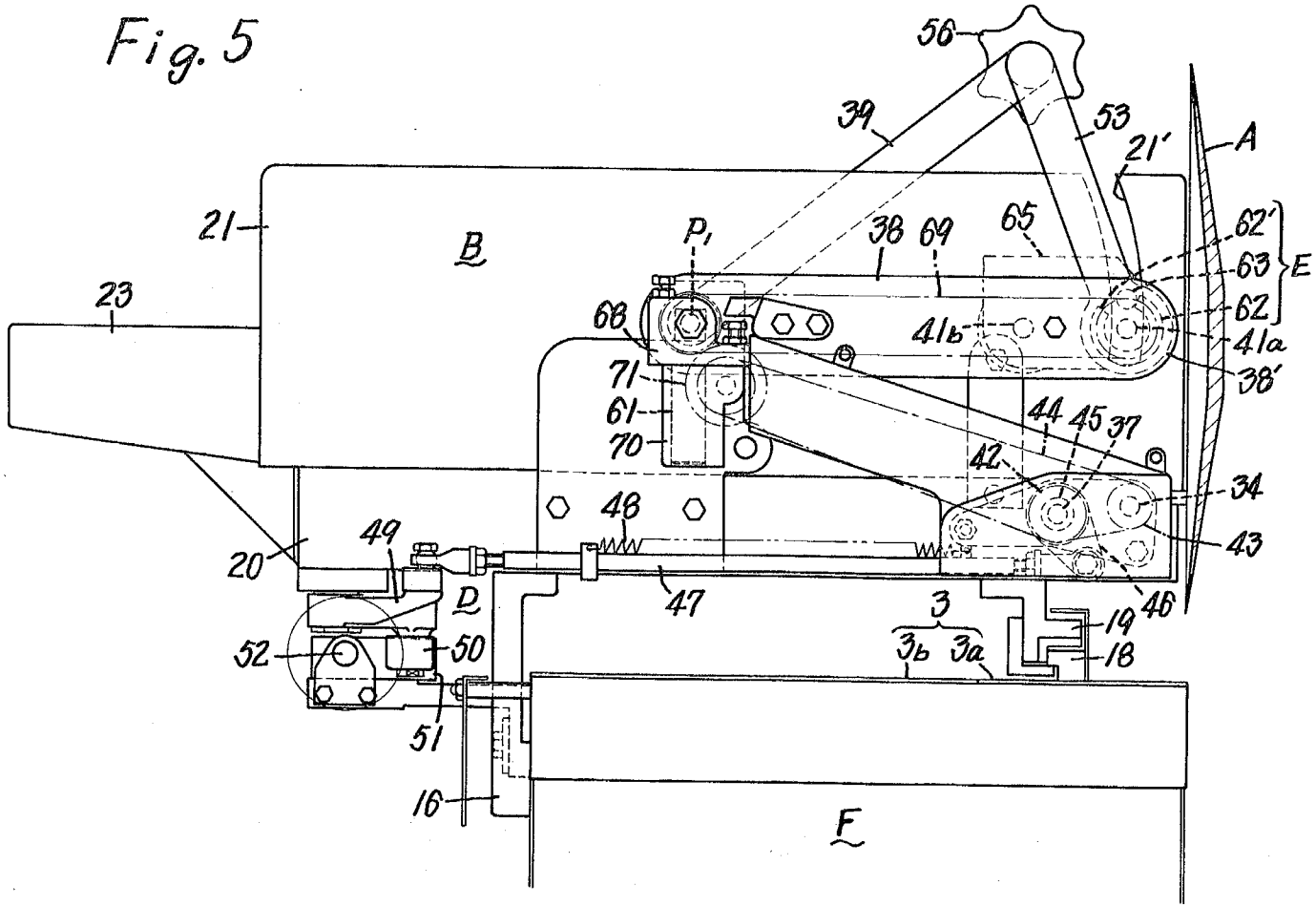
FIG. 5 is a rear view, showing principally the meat case.

As shown in FIG. 5 the upper conveyor Cb is caused to rotate synchronously with the rotation of the lower conveyor Ca by means of a transmission mechanism comprising a chain transmission means 69 mounted in said arm 38, a gear transmission means made up of a pair of gears provided between a bracket 68 pivotally secured to said arm 38 at the pivot axle $P_1$ and an arm bracket 70 secured movably to the fixed side wall 21 to support said bracket 68 in such a manner as to permit the latter to rotate horizontally. Said chain member 44 engaging the arm bracket 70 and the chain wheels 42 and 43 adapted to drive the drive shaft 37 of the lower conveyor and the driving shaft 34.

Said drive shaft 37 and the chain wheel 42 which is directly connected therewith are driven only when the meat case B is moved backward because of an intermittent feeding mechanism D comprising a one-way clutch 45 mounted coaxially therewith on the outer end of said wheel 42, a crank 46 provided externally of said clutch 45, a connecting rod 47 provided horizontally, together with a recovering spring 48, on the outside of the fixed side wall 21 of the meat case B with its one end connected to the tip of the crank 46, a bell crank 49 pivotally secured onto the rear under-side of the meat case B with its one end connected to the other end of the connecting rod 47, a roller 50 secured to the other end of the bell crank 49, and a cam 51 secured to one side of the frame F so as to slide along the direction of travel of the meat case B for adjusting the advance of the meat by means of its inclined surface 51' positioned within the locus of travel of the roller 50 which reciprocates integrally with the meat case B.

In other words, during the interval wherein the meat case B advances to a position corresponding to the front face of the circular blade A, completes one full cutting cycle and retreats fully from the front face of the circular blade A with the rotation of the crank 10, the roller 50 is brought into contact with the cam 51, turns the bell crank 49 swingably and tracts the connecting rod 47 and the crank 46, thereby actuating the movement of the chain wheel 42 to impart an advancing motion to the upper and lower conveyors Ca and Cb. When the meat case B advances again, all of the above mentioned members are returned to the original position by the tracting force of the recovery spring 48 except the chain wheel 42 which, being connected to the intermittent feeding mechanism by means of the one-way clutch 45, does not turn reversely by the idle action of said clutch 45. The cam 51 for adjusting the amount of feed can be moved by the rotation of the adjusting rod 52 to adjust the amount of feeding in the range of several millimeters to approximately 30 millimeters.

Figure 7:
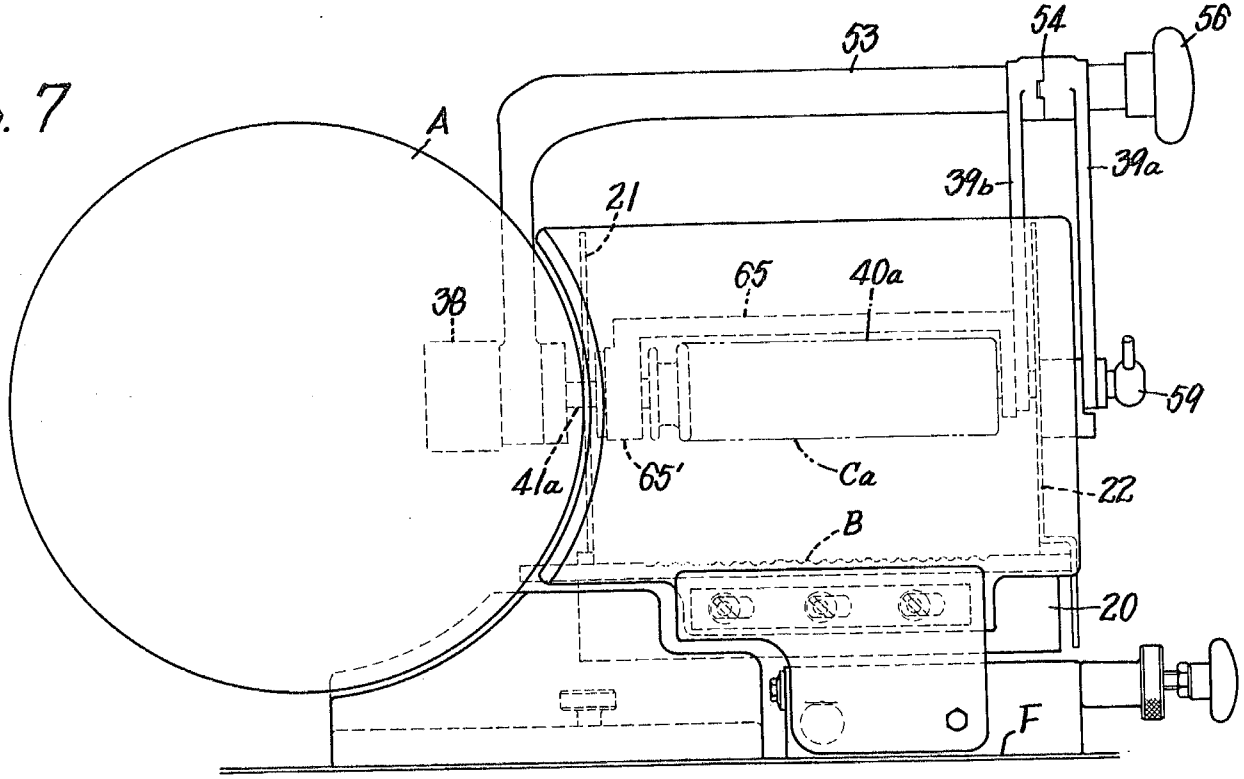
FIG. 7 is a side elevation of mainly a circular blade and the meat case as viewed from the left.

Referring now to the removal of the upper conveyor Cb, the auxiliary arm 39, one of the arms 38 and 39 supporting the conveyor Cb and having a fulcrum on the removable side wall 22 of the meat case B, is made up integrally of two elements, a main rod body 39*a* which is adapted to swing along the outer side of the side wall 22 and a tip end 39*b* which is movable vertically along the inner side of said side wall 22. Their connected portions are extended upward from the tip end 38' of the other arm 38 at the same angle as that of said tip end 39*b* and, as shown in FIG. 6 and FIG. 7, idly mounted on a handle shaft 53 which is extended horizontally to the front (viewing FIG. 6 and FIG. 7 from the front), transversing over the meat case B. The connected portions of the two elements are normally positioned at a fixed angle in a bent state as shown by means of mutual engagement of the mesh clutches 54 formed on the respective surfaces of contact and a compression spring 55 mounted on the handle shaft 53 together with a grip 56 in a manner so as to press said two elements in the direction of contact.

Further, engaged in the fulcrum axle $P_2$ provided on an arm bracket 57 which constitutes the fulcrum of the main rod body 39*a* of the arm 39 is a knob member 59 coupled with a tubular shaft 59', which is constantly forced by a tracting spring 58 in a manner so as to cause the knob 59 to move outward. The axial hole 39'*a* provided on the base rod body 39*a* of the arm 39 is aligned with the inner end of the knob 59. When the knob 59 is pulled toward the operator's side against the force of the tracting spring 58 after the handle shaft 53 is pulled up to raise the arms 38 and 39 to a position shown by an imaginary line in FIG. 1, the tubular shaft 59' of the knob 59 slides out of the axial hole 39'*a* to permit said axial hole 39'a to disengage from the pivotally secured shaft 56' by means of an opening 60 formed on a part of the periphery of the axial hole 39'a in such a manner as to thrust through said hole. Then, when the grip 56 of the handle shaft 53 is horizontally moved by hand to the right as seen in FIG. 1, the bracket 38 carrying the other arm 38 pivotally secured thereto along the fixed side wall 21 rotates anti-clockwise as seen in FIG. 3 on the fulcrum point of the hinge pin 61 mounted vertically in said arm bracket 70, thereby causing the base rod body 39a of the auxiliary arm 39 on the operator's side to disengage from the bracket 57.

Upon rotation of the arms 38 and 39 by the grip 56, said grip is pulled to the operator's side against the tracting force of the spring 55 to release the engagement of the base rod body 39a of the arm 39 with the mesh clutch 54 which holds the tip end 39b in position. The auxiliary arm 39 fixed in its bent position is pulled to the operator's side so as to disengage the tip end 39b of the arm 39 from the end of the rotatory shaft 41a, whereupon the arm 39 is released.

When the auxiliary arm 39 is released as above, the upper conveyor frame 65 can be pulled out to the operator's side while said rotatory shaft 41a remains supported only at one side by the other arm 38. By this pulling-out operation, the rear spike roller 40b which is integrated with the frame 42 can simultaneously be detached from the meat case B. Simultaneously with the detachment of the conveyor frame 42, the front spike roller 40a is pulled out of the rotatory shaft 41a which penetrates the center thereof, whereupon it is removed.

In the embodiment illustrated, two spike rollers 40a and 40b are provided on the upper conveyor Cb. However, there may be cases where said upper conveyor is formed by a single spike roller disposed to engage with the rotatory shaft 41a. Additionally, a guide groove 22' of the same profile as the foregoing arcuate groove 21' to accommodate said rotatory shaft 41a therein may be provided at the position where the tip end of said rotatory shaft 41a slides up and down along the side wall 22 of the meat case B, by which the vibration of said conveyor Ca can be suppressed during its operation.

As described, the upper conveyor Ca can be moved and advanced externally of the side wall 21 of the meat case B by either disengaging the removable auxiliary arm 39 from the fulcrum point $P_2$ and releasing the mesh clutch 54 to render only the base rod 39a freely swingable, or releasing the auxiliary arm 39 in its bent position and pushing it farther by manipulating the grip 56 on the handle shaft 53. For loading a work material into the meat case B of the slicer, the upper conveyor Ca can be moved out of the meat case B in this manner to facilitate the loading work.

The slicer of the present invention with the detachable upper conveyor Ca as above is characterized by such advantage that not only the detached conveyor Ca can be washed easily and thoroughly with water but also the cleaning of the meat case can be greatly facilitated by its removal from the slicer body.

The frame 42 of the upper conveyor Ca is freely rotatable, during the operation, on the fulcrum of the front-end rotatory shaft 41a, however, it is so disposed that the rear end of said frame 42 does not go down below a certain level when it engages in the meat case B through the provision on the external surface of the other side wall 42' carrying the shaft 41a therethrough, as shown in FIG. 5 and FIG. 6, stopper means E to prevent the rotation of said frame 42, comprising an annular stopper plate 62 mounted about said shaft 41a, a notch 62' formed by cutting off a portion of the stopper plate 62 at a suitable angle, and a stopper pin 63 having its tip end engage in said notch 62' and extending from the side surface of the base portion of the handle shaft 53 secured to the tip end 38' of one of the arms 38.

Said rotation stopper means E is particularly effective when used for the upper conveyor Ca employing a plurality of rollers since it not only increases the weight of the upper conveyor but also increases the area of the latter's contact with a work material whereby to transmit the feeding motion of the conveyor to the material precisely. Namely, as shown in the embodiment, this rotation stopper means E prevents the rotation of the frame 42 within a range defined by the notch 62' and maintains a desirable position for pressure contact on the material, especially in cases where the arm 38 swingable along the fixed side wall 21 of the meat case B is provided and so disposed that its tip portion 38' rotatably supports the frame 42 of the upper conveyor Ca carrying thereon a plurality of spike rollers, and said frame 42 is disposed to hold the rotatory shaft 41a constituting a drive shaft for the upper conveyor Ca at its one end so as to be easily detachable from the shaft 41a.

What is claimed is:

1. In a meat slicer comprising a circular blade rotatable vertically on one side of the machine frame, a meat case disposed to travel reciprocatingly on the machine frame along the plane of rotation of the circular blade, a lower conveyor member provided on the bottom surface of said meat case and an upper conveyor member disposed to engage into said meat case from above the said lower conveyor, a construction characterized by a crank chamber formed by and between a lower bed and an upper bed provided on the upper part of said machine frame and carrying on its one side an opening to be engaged by a slide bracket connected to said meat case, which crank chamber accommodating therein a crank member for driving said meat case, a rail member for engaging with a slide metal connected to said slide bracket and a connecting rod for connecting said crank with said slide metal, a receiving tray provided for covering the bottom surface of said crank chamber and an upper bed plate provided for covering the upper surface thereof.

2. The meat slicer according to claim 1, comprising an upper bed plate covering the upper surface of said upper bed consisting of a fixed plate secured to said upper bed and carrying thereon a rail member for supporting the travel of the front part of the meat case and a cover plate removably secured to the upper bed.

3. The meat slicer according to claim 1, comprising a lower conveyor provided on the bottom surface of the meat case so disposed as to be freely removable from the lower frame of said meat case.

4. The meat slicer according to claim 3, comprising a movable bearing member of adjustable length connected to one side of the frame of the lower conveyor and a bar conveyor belt whose both ends are linked together to form an endless chain engaging between a pulley member movably supported on said movable bearing member and a chain wheel provided on the other side of the frame.

5. The meat slicer according to claim 1, comprising an arm member freely swingable along the side wall of the meat case, a rotatory shaft movably provided on the tip end of the arm in a one-side supporting condition, and a spike roller removably mounted on the rotatory shaft and constituting an upper conveyor means.

6. The meat slicer according to claim 5, comprising an upper conveyor means consisting of a plurality of spike rollers, a conveyor frame supporting said rollers, and a stopper means for preventing the rotation of said frame consisting of a stopper plate provided between one side of the frame and the tip end of an arm member carrying the upper conveyor thereon, and a stopper pin engaging in a notch provided on said stopper plate.

* * * * *